United States Patent [19]

Sharp

[11] Patent Number: 4,756,441

[45] Date of Patent: Jul. 12, 1988

[54] FILE SYSTEM SUPPORT ASSEMBLY

[75] Inventor: Charles A. Sharp, Westborough, Mass.

[73] Assignee: Wright Line Inc., Worcester, Mass.

[21] Appl. No.: 869,140

[22] Filed: May 30, 1986

[51] Int. Cl.[4] ..... B65D 25/06; B42F 17/00

[52] U.S. Cl. ..... 220/22.5

[58] Field of Search ..... 220/22, 22.1, 22.2, 220/22.3, 22.5

[56] References Cited

U.S. PATENT DOCUMENTS

| | | | |
|---|---|---|---|
| Re. 30,396 | 9/1980 | Spees . | |
| 1,348,085 | 7/1920 | Cathcart | 220/22.1 |
| 1,409,160 | 3/1922 | Ehler | 220/22.1 |
| 1,574,526 | 2/1926 | Yeiser | 220/22.5 |
| 1,625,711 | 4/1927 | Cox | 220/22.3 |
| 1,730,069 | 10/1929 | Gebser | 220/22.1 |
| 1,814,191 | 7/1931 | Seyl | 220/22 |
| 2,153,123 | 4/1939 | Ruck | 220/22.3 |
| 2,523,722 | 9/1950 | Saaf | 220/22.1 |
| 3,301,263 | 1/1967 | Spees . | |
| 3,785,520 | 1/1974 | Spees . | |
| 4,232,463 | 11/1980 | Spees . | |
| 4,245,415 | 1/1981 | Spees . | |
| 4,344,242 | 8/1982 | Spees . | |

OTHER PUBLICATIONS

Touch Fan Filing Catalog Publication of Visu-Flex Company, 7633 Bequette Avenue, Pico Rivera, CA 90660.

*Primary Examiner*—George E. Lowrance
*Attorney, Agent, or Firm*—James W. Mitchell

[57] ABSTRACT

Disclosed is a removable, replaceable assembly for supporting a file system of the type which has a plurality of separator cards each of which is centrally apertured near its bottom to receive a locking rod. The cards are assembled behind the other. The assembly includes a pair of spaced parallel pivot rails (2, 4). Each rail has an upper pivot surface (6) lying in a common plane on which the bottom portions of the cards are supported for pivotal motion. Means (10, 36) join the pivot rails together and are located below the pivot surfaces of the rails. A locking rod (20) is located midway between the pivot rails of extends parallel to the rods and passes through the apertures in the separator card. Rod retaining means (24) extend upwardly from the joining means and are releasably engagable with the locking rod. The retaining means are apertured to position the rod between the rails at or below the plane of the pivot surfaces of the rails.

15 Claims, 3 Drawing Sheets

FILE SYSTEM SUPPORT ASSEMBLY

FIELD OF THE INVENTION

This invention relates to file systems in general and more specifically to removable, replaceable assemblies for supporting file systems in trays, desk drawers or on other appropriate support surfaces.

BACKGROUND OF THE INVENTION

There are numerous file card systems commercially available today which employ a stack of cards approximately 4"×6" in size which are assembled one behind the other. In older forms of this type of filing system, information was printed directly on the cards and the entire stack was positioned in a wooden, plastic, or metal box for removal, one card at a time.

This form of file system, while inexpensive, was not particularly convenient for one requiring frequent access to individual cards. Subsequently, a system was developed by the Visu-flex Corporation of California in which flat, flexible dividers or separator cards were constructed and stored in such manner that they allowed easy access and retrieval of separate media cards, such as microfiche, placed between each separator card. In this system, individual separator cards stand erect and evenly spaced in relation to their container, yet provide easy access to the removable media cards. The divider can be flexed to expose to view the face of any desired single media card and permit its removal. When a group of dividers or separator cards in the container are flexed and compressed together to expose a single media card, the group of dividers so flexed becomes essentially spring loaded, and when released, individual dividers spring back to erect, evenly spaced, relation in the container.

The removable media card, film, or paper stock, for example, being filed between the separator cards, are each thus protected from the other relative to abrasion, static cohesion, etc.

Such systems are disclosed in U.S. Pat. Nos. 3,301,263, 3,785,520 and 4,232,463. The system is referred to as the Touch-Fan filing principle.

The media cards and dividers or separators are contained in custom containers. The bottoms of the dividers are centrally apertured and a retaining rod passes through the stack of dividers. The media cards are not apertured, thus permitting their easy removal. The retaining rod, while itself removable, is integral with the custom container designed for this specific card file system.

This is but one example of a file card system. There are many others commercially available, but generally speaking, each requires its own separate container.

It is an object of this invention to provide a removable, replaceable assembly for supporting a file system of the type which includes a plurality of dividers centrally apertured near their bottoms to receive a locking rod and which dividers are assembled one behind the other to separate removable media cards.

There are many containers such as trays, drawers and the like which are intended to have universal application which are not necessarily designed for any one file card system, however, if a tray is designed for a particular system only, when the system becomes obsolete, so does the tray.

It is accordingly another object of this invention to design a file card support system for retrofit or adaptation to existing trays, drawers and the like which will permit a file system of the type described above to be accommodated within such existing trays or drawers.

It is another object of this invention to provide a file system support assembly for a file card system the type embodying the Touch-Fan filing principle for use on a desk top or similar supporting surfaces.

SUMMARY OF THE INVENTION

The invention resides in a removable, replaceable assembly for supporting a file system of the type which as a plurality of dividers or separator cards centrally apertured near their bottoms to receive a retaining rod and which dividers are assembled one behind the other to separate removable media cards.

The assembly includes a pair of spaced parallel pivot rails each of which has an upper pivot surface lying in a common plane upon which the bottom portions of separator cards are supported for pivotal motion relative to the vertical. The rails also support the removable media cards. Means are provided for joining the pivot rails together and are located below the pivot surfaces of the rails so as not to interfere with the pivotal motion of the cards supported on the rails. The joining means can take the form of a continuous sheet extending between the rails from front to rear or comprise beams extending between the rails at the front and rear of the rails.

A locking rod is located midway between the pivot rails and extends parallel to and is supported at or below the pivot surfaces of the rails by rod retaining means which extend upwardly from the joining means. The locking rod is releasably engagable with the joining means.

Vertical constraint means may be employed for limiting the amount of incline of the separator cards and media cards from the vertical and comprise front and rear wall members between the rails at opposite ends thereof. The vertical constraining means are inclined away from each other in the upward direction.

Lateral constraint means may also be employed to engage the edges of the separator cards and comprise parallel wall members extending upwardly from the outer sides of the pivot rails to a position above their pivot surfaces.

Means may also be employed to accommodate "wobble blocks" which are positioned between groups of dividers or separator cards.

The above and other features of the invention including various novel details of construction and combinations of parts will now be more particularly described with reference to the accompanying drawings and pointed out in the claims. It will be understood that the particular file system support assembly embodying the invention is shown by way of illustration only and not as a limitation of the invention. The principles and features of this invention may be employed in varied and numerous embodiments without departing from the scope of the invention.

BEST MODE OF CARRYING OUT THE INVENTION

The invention will be disclosed residing in a removable, replaceable assembly for supporting a file system which has a plurality of dividers or separator cards centrally apertured near their bottoms and assembled one behind the other to receive a locking rod and which dividers have removable media cards positioned between them.

Figure 1:
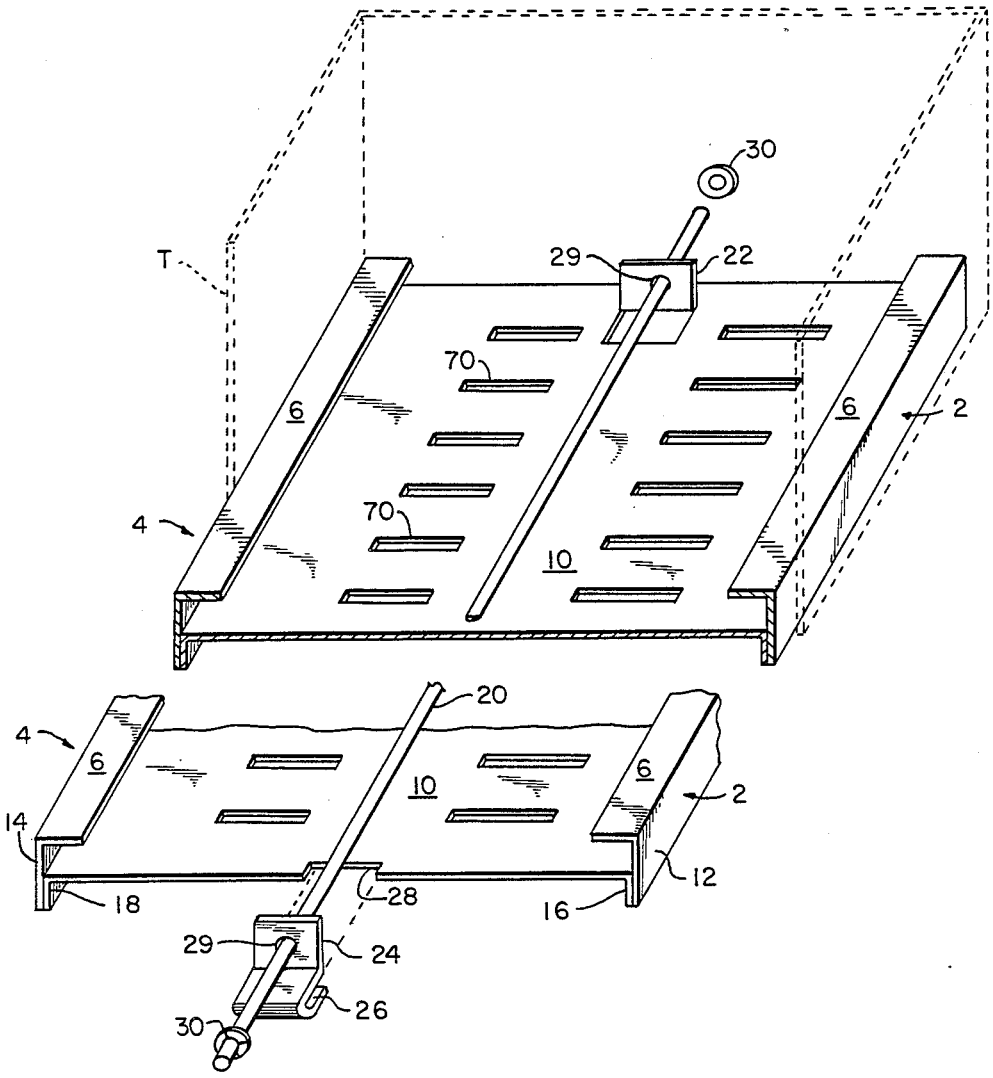
FIG. 1 is a perspective view of one embodiment of the file system support assembly embodying the invention and which is partially exploded for clarity.

The assembly, shown positioned in a tray T in FIG. 1 includes a pair of spaced parallel pivot rails 2 and 4. Each rail has an upper pivot surface 6 which lie in a common horizontal plane. Bottom edge portions of separator cards, which may have a number of configurations, and the removable media cards rest and pivot on the horizontal pivot surfaces 6 as will be explained in more detail hereinafter. The rails are secured together by joining means which are located below the pivot surfaces 6. In the embodiment shown in FIG. 1, the joining means comprises a continuous sheet 10 extending between the rails below the pivot surfaces 6.

The rails include depending legs 12 and 14 and the sheet 10 includes depending legs 16 and 18 which may be either welded or otherwise joined to the legs 12 and 14. If preferred, the rails 2 and 4 and the sheet 10 may be made of one piece of stamped or bent sheet material, such as steel, with the legs 12, 14, 16, and 18 continuous and bent over on each other.

A locking rod 20 is located midway between the pivot rails 2 and 4 and extends parallel thereto to retain the separator cards in the assembly. Rod retaining means extend upwardly from the sheet 10 and comprise a rear tab 22 partially punched out of and bent upwardly from the sheet 10. A removable spring clip tab 24 is located at the front of the plate. It has a "U" shaped section and is engagable in a slot 28 in the sheet 10. Each of the tabs has a central aperture 26 through which the rod 20 passes. To prevent the rod 20 from sliding out of the tabs, removable fasteners 30, such as Tinnerman fasteners, are positioned on the rod.

The apertures 26 in the tabs 22 and 24 are formed at a precise level to maintain the rod 20 between the rails 2 and 4 at or below the plane of the pivot surfaces 6.

Figure 1A:
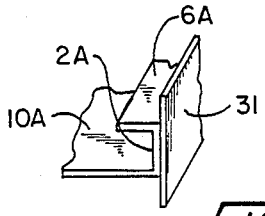
FIG. 1A is a detail perspective view of a portion of one of the support rails.

As will be seen in FIG. 1A, if desired, the pivot rail 2A may be formed integral with the sheet 10A and secured to a vertical wall member 31. The horizontal portion 10A represents a portion of the sheet 10 shown in FIG. 1.

Figure 2:
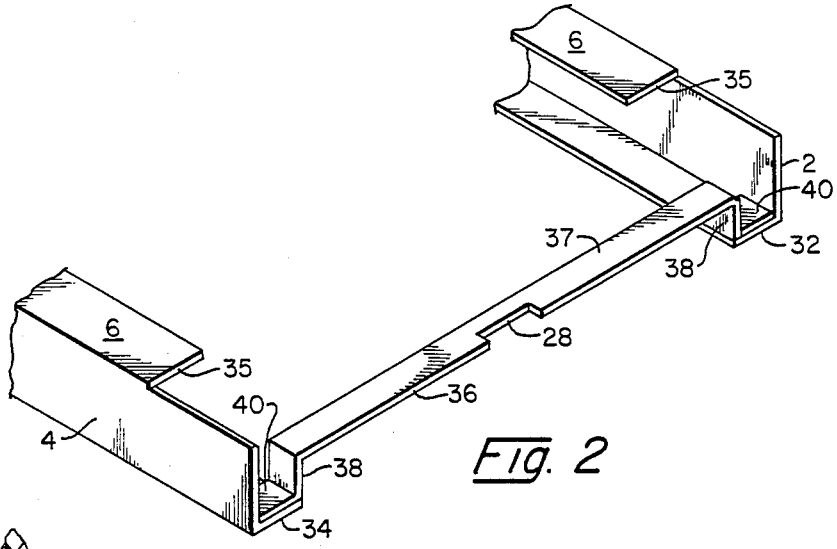
FIG. 2 is a perspective view of another embodiment of the file system support assembly.
Figure 3:
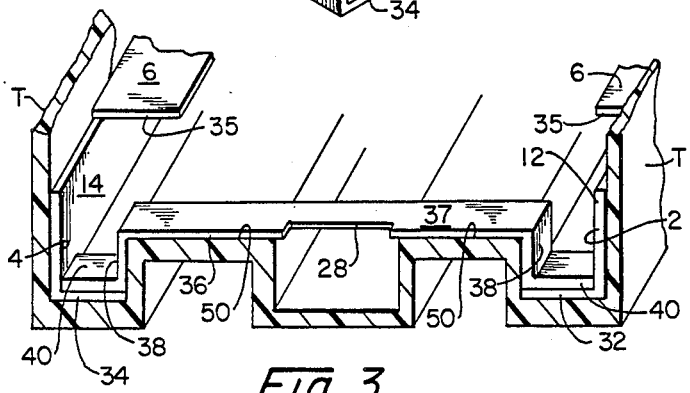
FIG. 3 is a perspective view of the support assembly shown in FIG. 2 looking from front to rear.
Figure 5:
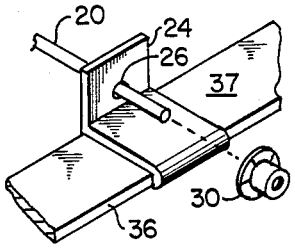
FIGS. 5, 6 and 7 are perspective views of various embodiments of locking rod retaining means.

An alternative embodiment will be seen in FIGS. 2 and 3. The pivot rails 2 and 4 have pivot surfaces 6, as do those in the FIG. 1 embodiment. The rails also include vertical side walls 12 and 14 (FIG. 3). Horizontal rails 32 and 34 extend inwardly from the side walls 12 and 14.

Resting on the front and rear portions of the rails 32 and 34 is the joining means. In this embodiment, it comprises a pair of beams 36, one at the front and one at the rear of the pivot rails 2 and 4. The pivot rails 2 and 4 may be cut away at 35 to accommodate the beams 36 and facilitate easy assembly. The beams have a flat upper surface 37, depending vertical legs 38 and horizontal feet 40 which rest on and may, if desired, be secured to the bottom rails 32 and 34 of the pivot rails. The beam 36 which is located at the back portion of the supporting assembly is not shown in the Figures.

The rod retaining means is similar to that in the FIG. 1 embodiment and includes, on the front beam 36, an apertured spring clip 24 which, when assembled, enters a notch 28 in the beam 36.

Figure 6:
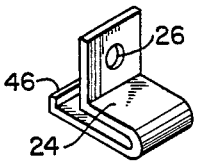

As seen in FIG. 6, the spring clip 24, as in the FIG. 1 embodiment, includes an aperture 26 for receiving and maintaining the locking rod 20 at or below the pivot surfaces 6. In the FIG. 6 configuration, an upwardly extending toe 46 is formed on the clip 24 to engage behind the beam 36 to hold the clip on the beam.

Figure 7:
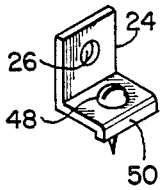

In FIG. 7 a different version of the clip is shown. It is held by a screw 48 to the beam 36 in cooperation with a downwardly depending toe 50.

As seen in FIG. 3, the front portion of the assembly is shown contained within a tray T with the beams 36 resting on a pair of upper elevated rib portions 50 which are parts of the particular tray herein illustrated. The horizontal rail portions 32 and 34 of the pivot rails 2 and 4 rest on the bottom of the tray with the horizontal feet 40 of the beam 36 on the horizontal rails 32 and 34. The pivot rails and the beams may be secured together, if desired.

Figure 9:
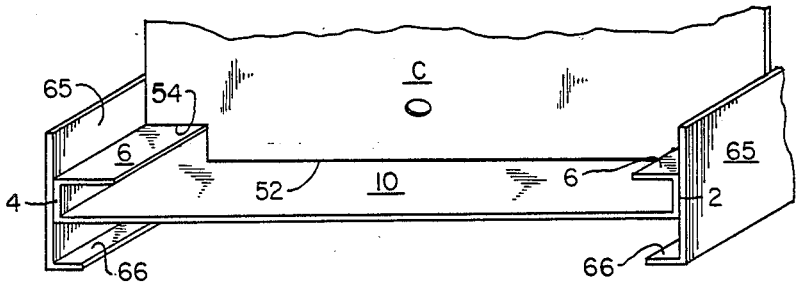

A portion of one illustrative form of separator card C is shown in FIG. 9. It is generally rectangular and has a central, depending portion 52. It is notched at the bottom edges to provide horizontal pivot edges 54 (only one of which is visible in FIG. 9). The pivot edges are supported by and pivot on the pivot surfaces 6 of the rails 2 and 4 with the central portion 52 extending between the rails below the surfaces 6.

Figure 4:
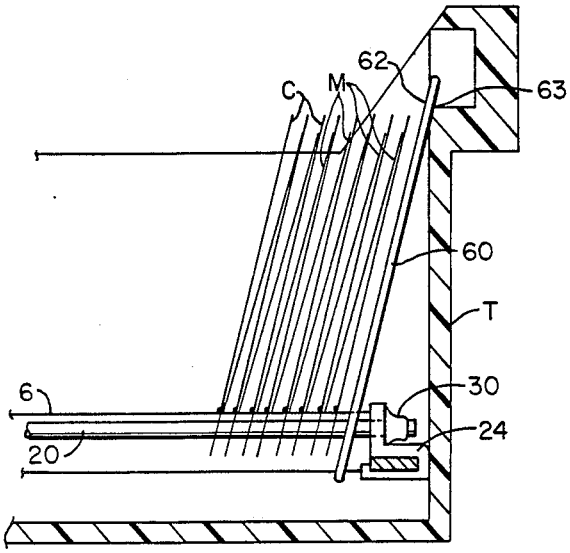
FIG. 4 is a right side elevation, partly in section, of portions of the FIG. 1 or 2 embodiments of the support assembly positioned within a tray and with parts removed for clarity.

The forward end of the assembly is shown in FIG. 4 in side elevation with the pivot rails 12 and 14 removed for clarity but with the pivot surfaces 6 illustrated for reference purposes. Media cards M are shown between the separator cards C, with the locking rod 20 passing through the separator cards and with the media cards resting on the surfaces 6 above the rod 20.

Means are provided to limit the amount of incline of separator cards C and, hence, media card, from the vertical, comprising front and rear wall members 60, only one of which is shown in FIG. 4. The wall members 60 fit between the pivot rails at the opposite ends of the assembly. The lower end of the wall members 60 fit in front of the beams and between the pivot rails. The upper portion 62 of each wall member is shown resting against an upper corner 63 of the tray in which the assembly as been placed.

If it is not intended that the assembly be placed in a tray, the front and rear wall members would be secured at the desired angle to the assembly itself, as for example, the joining means, such as the beams 36 or the continuous sheet 10 extending between the pivot rails 2 and 4.

Lateral constraint means for the cards C may also be employed as shown in FIG. 9. In this figure, the FIG. 1 embodiment of the assembly, i.e., that employing the continuous sheet 10 is shown. Although this embodiment is shown for illustration the FIG. 2 embodiment could be employed as well.

Vertical parallel members 65 extend upwardly from the outsides of the pivot rails 2 and 4 to a position above their pivot surfaces 6. These members 65 engage the edges of the cards C, the bottom pivot edges of which rest and pivot on the pivot surfaces 6. If desired, horizontal feet 66 may be located on the bottoms of the lateral constraint members 65. This feature would be employed if, for example, the support assembly were to be positioned on a flat surface such as a desk top or in a wide drawer.

Figure 8:
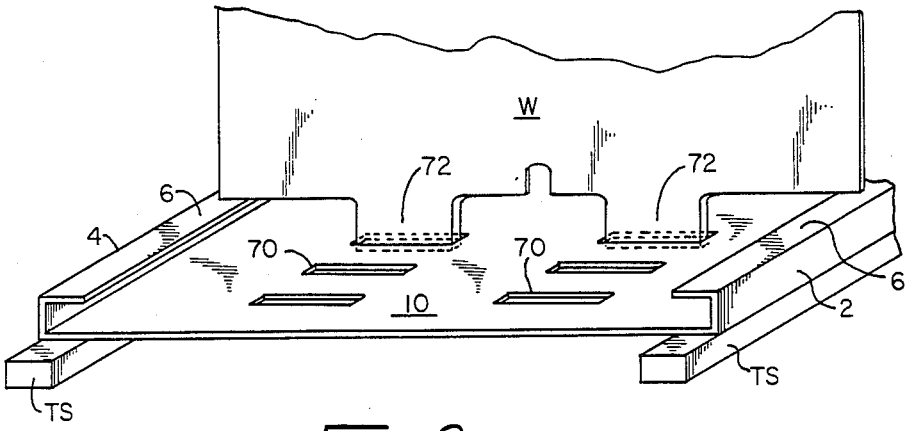
FIGS. 8, 9 and 10 are perspective views of alternative constructions of the support assembly shown in FIG. 1.

Another alternative construction of the invention is shown in FIG. 8. The continuous sheet 10 constitutes the bottom of the assembly with no integral portion extending below it. This embodiment would be used where the assembly is positioned within a tray that had its own support members TS so that the sheet 10 would be raised above the bottom of the tray.

There will be seen in FIGS. 1 and 8 a plurality of slots 70 in the sheet 10 which extend between the rails from front to rear. They are elongated and are disposed normal to the rails. The purpose of the slots are to accept downwardly extending tabs 72 of "wobble blocks" W. These are rigid members inserted at intervals within a group of cards to help absorb the weight of the inclined cards and relieve the strain of such weight from the adjacent group of cards as will be found in some forms of filing systems. The blocks W are notched at 73 to accommodate the locking rod 20 (not shown) and to permit the "wobble block" to pivoted. The "wobble blocks" are removable.

It will be obvious that if the support member of FIG. 8 is employed on a desk top, the tabs 72 of the "wobble blocks" W shown in FIG. 8 would not be used because the tabs could not project below the bottom of the tray 10 and permit the cards to pivot relative to tray to perform their above described function. "Wobble blocks" W of a configuration similar to the separator card C shown in FIG. 9 could be used with the FIG. 9 configuration.

Figure 10:
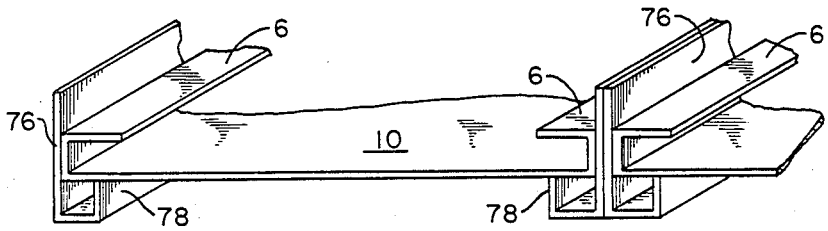

Should it be desired to use one or more assemblies as inserts for drawers or on wide surfaces, lifting and separating members 76 would be employed as seen in FIG. 10. They include vertical upstanding walls 78 upon which the sheet 10 or beams 36, including the pivot rails 2 and 4, can be supported. Also, as seen in FIG. 10, if desired, a plurality of support assemblies can be positioned side by side, in a drawer or on a desk top with the wall of a member 76 abutting corresponding the wall of the adjacent assembly.

I claim:

1. A removable, replaceable assembly for supporting a file system within a file draw or on a desk top or the like, the system being of the type which has a plurality of separator cards, each centrally apertured near its bottom and located one behind the other, the assembly conprising:

a pair of spaced, parallel pivot rails, each having a lowermost surface which is engageable with a support such as the bottom of a file drawer, each rail also having a flat upper pivot surface above the lowermost surface, and lying in a common plane, means joining the pivot rails together, which means are located below the pivot surfaces of the rails, a locking rod located midway between the pivot rails and extending parallel thereto to pass through the apertures in the separator cards, and rod retaining means secured to and extending upwardly from the joining means and releasably engageable with the locking rod and having means to position the rod between the rails at or below the plane of the pivot surfaces of the rails and above the lowermost surfaces, and whereby bottom lateral portions of the separator cards can be supported on the pivot surfaces of the rails with the locking rod extending removably through the apertures in the cards and one or more central portions of the cards may extend below the pivot surfaces whereby the entire assembly may be placed in a tray, drawer, or on other supporting surfaces with the lowermost surfaces of the rails on the support surface.

2. A removable, replaceable assembly for supporting a file system within a file draw or on a desk top or the like, the system being of the type which has a plurality of separator cards, each centrally apertured near its bottom and located one behind the other, the assembly comprising:

a pair of spaced, parallel pivot rails, each having a lowermost surface which is engageable with a support such as the bottom of a file drawer, each rail also having a flat upper pivot surface above the lowermost surface, and lying in a common plane, means joining the pivot rails together, which means are located below the pivot surfaces of the rails, a locking rod located midway between the pivot rails and extending parallel thereto to pass through the apertures in the separator cards, and rod retaining means extending upwardly from the joining means and releasably engageable with the locking rod, at least one of the retainig means being removable from the joining means, and means to position the rod on the joining means between the rails at or below the plane of the pivot surfaces of the rails, and vertical constraint means for limiting the amount of incline of the separator cards from the vertical comprising front and rear wall members located between the rails at opposite ends thereof and inclined away from each other in the upward direction.

3. A removable, replaceable assembly for supporting a file system within a file draw or on a desk top or the like, the system being of the type which has a plurality of separator cards, each centrally apertured near its bottom and located one behind the other, the assembly comprising:

a pair of spaced, parallel pivot rails, each having a lowermost surface which is engageable with a support such as the bottom of a file drawer, each rail also having a flat upper pivot surface above the lowermost surfce, and lying in a common plane, means joining the pivot rails together, which means are located below the pivot surfaces of the rails, a locking rod located midway between the pivot rails and extending parallel thereto to pass through the apetures in the separator cards, and rod retaining means extending upwardly from the joining means and releasably engageable with the locking rod, at least one of the retaining means being removable from the joining means, and means to position the rod on the joining means between the rails at or below the plane of the pivot surfaces of the rails, and lateral card constraint means comprising parallel wall members extending upwardly from the outer sides of the pivot rails to a position above their pivot surfaces.

4. Support assembly according to claim 1 wherein the joining means is a continuous flat sheet extending between the rails from front to rear.

5. Support assembly according to claim 2 wherein the joining means is a continuous flat sheet extending between the rails from front to rear.

6. Support assembly according to claim 3 wherein the joining means is a continuous flat sheet extending between the rails from front to rear.

7. Support assembly according to claim 1 wherein the joining means is a continuous flat sheet extending between the rails from front to rear and wherein there are rows of elongated slots disposed normal to the rails.

8. Support assembly according to claim 2 wherein the joining means is a continuous flat sheet extending between the rails from front to rear and wherein there are rows of elongated slots disposed normal to the rails.

9. Support assembly according to claim 3 wherein the joining means is a continuous flat sheet extending between the rails from front to rear and wherein there are rows of elongated slots disposed normal to the rails.

10. Support assembly according to claim 1 wherein the joining means comprise beams extending between the rails at the front and rear thereof.

11. Support assembly according to claim 2 wherein the joining means comprise beams extending between the rails at the front and rear thereof.

12. Support assembly according to claim 3 wherein the joining means comprise beams extending between the rails at the front and rear thereof.

13. Support assembly according to claim 1 wherein the rod retaining means comprise upstanding, apertured tabs engageable with the front and rear ends of the joining means, at least one tab being removable.

14. Support assembly according to claim 2 wherein the rod retaining means comprise upstanding, apertured tabs engageable with the front and rear ends of the joining means, at least one tab being removable.

15. Support assembly according to claim 3 wherein the rod retaining means comprise upstanding, apertured tabs engageable with the front and rear ends of the joining means, at least one tab being removable.

* * * * *